US007472522B2

(12) United States Patent
Yang

(10) Patent No.: US 7,472,522 B2
(45) Date of Patent: Jan. 6, 2009

(54) PROTECTIVE REBAR COVER

(75) Inventor: Yongjian Yang, Nanjing (CN)

(73) Assignee: Mutual Industries North, Inc., Philadelphia, PA (US)

( * ) Notice: Subject to any disclaimer, the term of this patent is extended or adjusted under 35 U.S.C. 154(b) by 0 days.

(21) Appl. No.: 11/655,659

(22) Filed: Jan. 17, 2007

(65) Prior Publication Data

US 2008/0168726 A1 Jul. 17, 2008

(51) Int. Cl.
*E04H 12/00* (2006.01)
*F16M 13/00* (2006.01)
*B65D 59/00* (2006.01)

(52) U.S. Cl. ..... 52/301; 52/244; 248/523; 138/96 R

(58) Field of Classification Search ..... 52/301, 52/300, 689, 244; 248/523; 138/96 R
See application file for complete search history.

(56) References Cited

U.S. PATENT DOCUMENTS 4,202,378 A 5/1980 Bush et al.
D262,093 S 12/1981 Bush et al.
4,343,399 A 8/1982 Patel et al.
4,833,850 A 5/1989 Lunn
5,301,485 A 4/1994 Shaw et al.
5,313,757 A 5/1994 Schnepf
5,324,356 A * 6/1994 Goodwin ..... 106/638
5,363,618 A 11/1994 Underwood
5,381,636 A 1/1995 Kassardjian et al.
5,447,290 A 9/1995 Workman
D363,657 S 10/1995 Kassardijian et al.
5,469,679 A 11/1995 Burkard et al.
5,523,043 A 6/1996 Kassardijiam et al.
5,568,708 A 10/1996 Kassardijian et al.
5,613,336 A * 3/1997 Workman ..... 52/301
5,729,941 A * 3/1998 Kassardjian et al. ..... 52/301
5,824,253 A 10/1998 Kassardijian et al.
5,884,443 A 3/1999 Schimmelpfennig et al.
D408,268 S 4/1999 Dunn (Continued)

FOREIGN PATENT DOCUMENTS

JP 10-331028 2/1998

(Continued)

OTHER PUBLICATIONS

U.S. Appl. No. 09/569,826, Dunn.

(Continued)

*Primary Examiner*—Richard E Chilcot, Jr.
*Assistant Examiner*—Andrew J Triggs
(74) *Attorney, Agent, or Firm*—Joseph E. Mueth

(57) ABSTRACT

Briefly, this invention comprises a rebar protective cover for use on the projecting free end of a concrete reinforcing bar to prevent impact injuries comprising:

(a) a hollow cylindrical collar, having an open end and a closed end, (b) an overhanging impact head of substantial extent projecting laterally outwardly beyond the closed end of said collar, (c) a bowl-shaped shaping member having the concave surface facing the open end of the collar, (d) a solid cementitious member occupying the space between said closed end of the collar and the underside of said shaping member, said cementitious member having a surface abutting the underside of said shaping member complementary to said shaping member and adapted to resist impact penetration, said protective cover preventing penetration of the cover by rebar.

18 Claims, 8 Drawing Sheets

U.S. PATENT DOCUMENTS

| | | | | |
|---|---|---|---|---|
| 5,943,836 | A | 8/1999 | Kassardijian et al | |
| 5,946,871 | A | 9/1999 | Kassardijian et al. | |
| 5,950,680 | A | 9/1999 | Randall | |
| 6,073,415 | A * | 6/2000 | Carnicle | 52/698 |
| 6,606,836 | B2 * | 8/2003 | Miller | 52/741.14 |
| 6,857,235 | B2 * | 2/2005 | Niday et al. | 52/301 |
| 2003/0050178 | A1 * | 3/2003 | Agarwala et al. | 501/96.3 |

FOREIGN PATENT DOCUMENTS

| | | | |
|---|---|---|---|
| WO | WO 91/14839 | A1 | 10/1991 |

OTHER PUBLICATIONS

J.A. Brydson, "Plastic Materials", 7th Edition, Butterworth-Heinemann (pubs.), Oxford, England, (1999), pp. 205-246.

Don Decristo Concrete Accessories, Catalog, p. 43.

Deslauriers, "Impalement-Protection Saftey Cap DISC System", promotional flyer, Jun. 12, 1996.

American Allsafe Company, "The Changing of the Guard", promotional flyer.

Mutual Industries, Inc., "Rebar Safety Products", Catalog, p. 39.

* cited by examiner

PROTECTIVE REBAR COVER

FIELD OF INVENTION

This invention relates to protective covers for exposed steel reinforcing bars used in reinforced concrete.

BACKGROUND OF INVENTION

Steel reinforcing bars ("rebar") are used in reinforced concrete in building structures. During the construction of buildings, the ends of the rebar are often exposed and extend upwardly from recently poured concrete sections or walls. Exposed ends are sharp and present a hazard to workmen, particularly to workmen working overhead. Many workmen have sustained puncture injuries, and in a significant number of cases have been killed, due to accidentally falling or stepping onto the exposed ends of the rebar.

Various protective safety covers have been proposed and used to protect workmen from this hazard. Bush U.S. Pat. No. 4,202,378 and Bush Design Pat. No. 262,093 refer to a protective safety cover for use on the free projecting ends of rebar comprising a hollow cylindrical body of a deformable plastic material, the body being closed at one end and open at the other. A plurality of inwardly extending projections are formed within the open end of the cylindrical body to secure the protective cover to the rebar. The closed end of the body has a flat circular head which extends radially outwardly from the body to present an enlarged flat impact surface. Other plastic protective covers for rebar are discussed in Schimmelpfenning U.S. Pat. No. 5,884,443 and Don De Cristo Concrete Accessories Inc. Catalog "Plastic Rebar Guard", p. 43. Lunn U.S. Pat. No. 4,833,850 proposed a protective cover for rebar in the form of a metal support adapted to hold a impact absorbing spherical cushion.

When it was realized that these all plastic protective covers were subject to penetration upon severe impact, such as a workman falling from a height, it was proposed to insert a separate piece of rebar through lateral holes near the closed end of the cylindrical body to provide for a steel stop as discussed in WO91/14839 and Underwood U.S. Pat. No. 5,363,618. This approach is not self-contained, is inconvenient, and subject to not being consistently practiced.

Consequently, protective covers having a built in metal plate or "seat" in the bottom of the closed end of the body were developed. Protective covers of this type are discussed in Schnepf U.S. Pat. No. 5,313,757, Workman U.S. Pat. Nos. 5,447,290 and 5,613,336, Deslauriers Impalement Protective "Safety Cap DISC System", Buffalo American Allsafe Company "BarGard", Mutual Industries Inc. OSHA Rebar Cups Part Numbers 14640-4 and 14640-5, Dunn U.S. Design Pat. No. 408,268, and Kassardjian et al U.S. Pat. Nos. 5,381,636, 5,523,043, 5,568,708, 5,824,253, 5,943,836, 5,946,871 and Design No. 363,657. Protective covers with metal plates or seats passed the original Cal OSHA drop test.

However, after an investigation of job site injuries, Cal OSHA subsequently declared that the existing protective covers with metal plate or seat were inadequate, primarily due to being subject to penetration through the side of the cylindrical body upon impact on the head, resulting in serious puncture injuries to workmen falling onto the rebar.

Cal OSHA since established a new and more stringent drop test which all new rebar protective covers are required to meet. Kassardjian et al U.S. Pat. No. 5,729,941 relates to a rebar cover having a preformed metal stamping in the form of a bowl-shaped metal seat which is incorporated in the closed inner end of the cylindrical body. The bowl-shaped metal seat is said to be of a composition and thickness to prevent penetration of the rebar through the seat and thereby preclude penetration of the rebar through the side of the cover body upon impact.

The use of a preformed bowl-shaped metal stamping as the seat adds to the expense of the rebar protective cover.

Subsequently, a rebar protective cover having a hollow cylindrical body and impact head of a thickness and integrally formed of a plastic material was developed which was found to provide a protective cover which passes the current Cal OSHA drop test. This rebar protective cover is disclosed in applicant's co-pending U.S. patent application Ser. No. 09/569,826, filed May 12, 2000, the disclosure of which is incorporated herein by reference.

SUMMARY OF THE INVENTION

Briefly, this invention comprises a rebar protective cover for use on the projecting free end of a concrete reinforcing bar to prevent impact injuries comprising:

(a) a hollow cylindrical collar, having an open end and a closed end,
(b) an overhanging impact head of substantial extent projecting laterally outwardly beyond the closed end of said collar,
(c) a bowl-shaped shaping member having the concave surface facing the open end of the collar,
(d) a solid cementitious member occupying the space between said closed end of the collar and the underside of said shaping member, said cementitious member having a surface abutting the underside of said shaping member complementary to said shaping member and adapted to resist impact penetration, said protective cover preventing penetration of the cover by rebar when the cover is subjected to the Cal OSHA drop test.

The invention further comprises the combination of a rebar used to reinforce concrete wherein the rebar has an exposed free end and a safety protective cover disposed on said exposed, said protective cover comprising:

(a) a hollow cylindrical collar, having an open end and a closed end,
(b) a flat overhanging impact head of substantial extent projecting laterally outwardly beyond the closed end of the collar,
(c) a bowl-shaped shaping member having the concave surface facing the open end of the collar,
(d) a solid cementitious member occupying the space between said closed end of the collar and the underside of said shaping member, said cementitious member having a surface abutting the underside of said shaping member complementary to said shaping member and adapted to resist impact penetration.

said protective cover preventing penetration of the cover by rebar when the cover is subjected to the Cal OSHA drop test.

DESCRIPTION OF PREFERRED EMBODIMENTS

Turning to the drawings.

Figure 1:
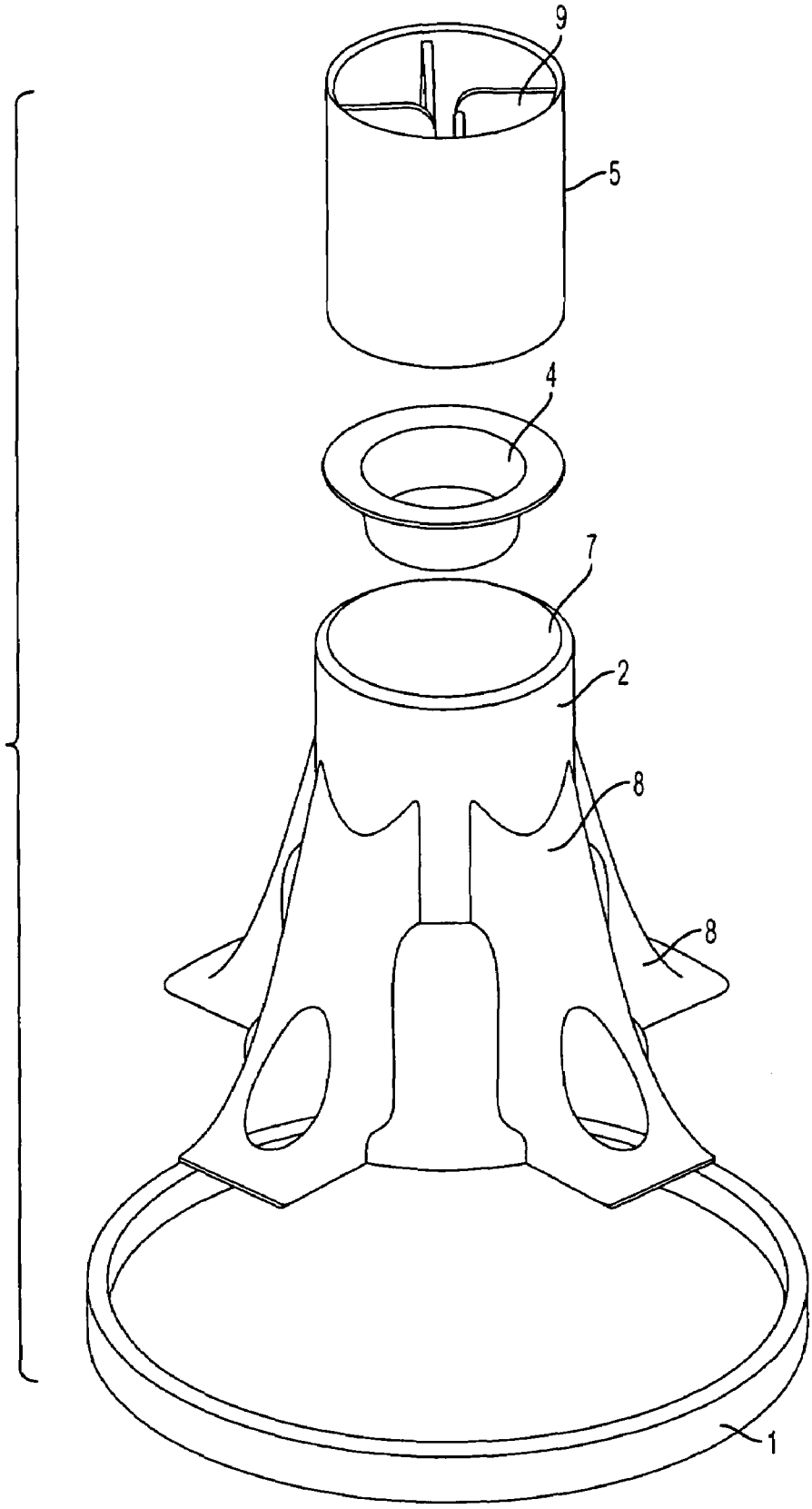
FIG. 1 is an exploded perspective view of the plastic parts of the protective cover of this invention.

The hollow cylindrical collar 2 is closed at one end 6 and is open at the other 7. The flat impact head 1 is formed so that when joined to the cylindrical collar 2, the impact head extends beyond and overhangs the collar 2.

The separately formed impact head 1 as shown is preferably circular and has an area of about 16 square inches as required by Cal OSHA. The impact head can also be square.

Four web-like buttresses 8, spaced at a 90° interval, help support the periphery of the impact head 1 around its underside.

The fin holder 5 has the inside flanges 9 serve to keep the protective cover longitudinally aligned with the rebar 10 by gripping the sides of the rebar.

The fin holder 5, the shaping member 4, the collar 2 and the impact head 1 are first individually formed by injection molding of the polyolefins described herein.

Figure 2:
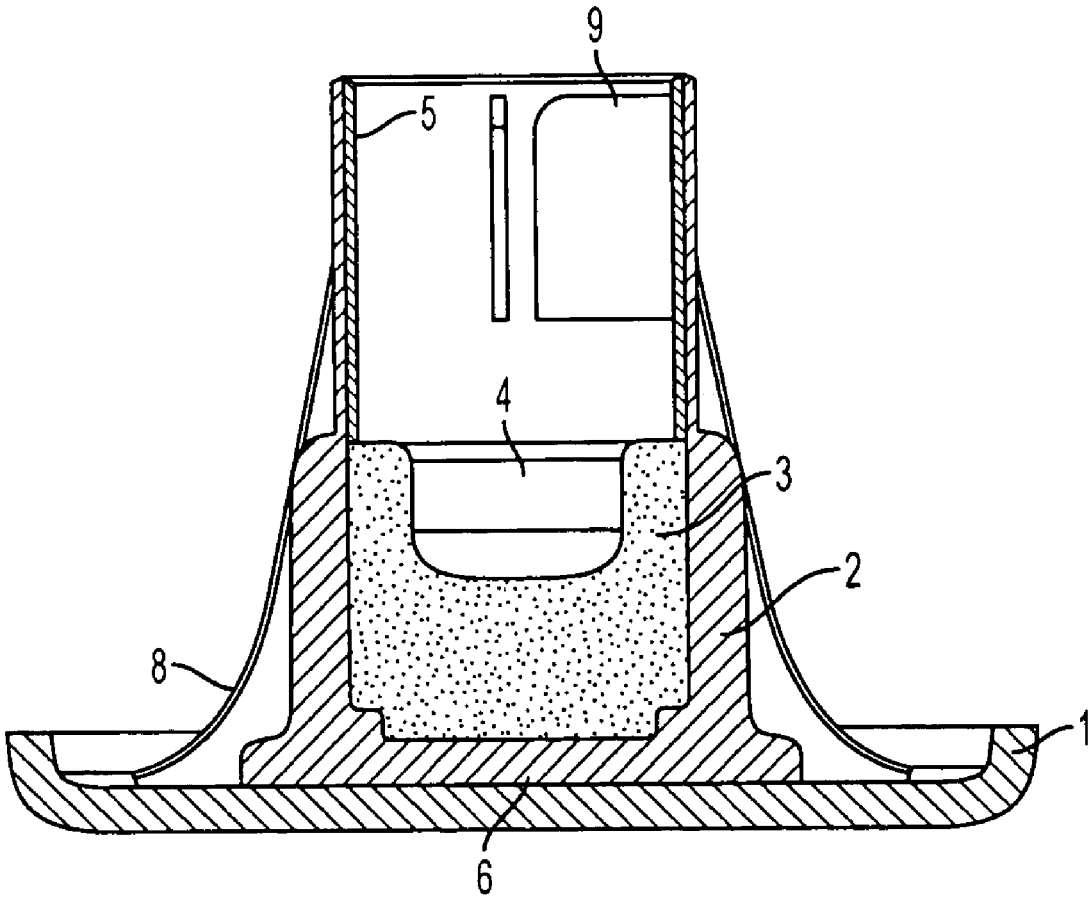
FIG. 2 is a sectional view of the assembled protective cover of this invention.
Figure 3:
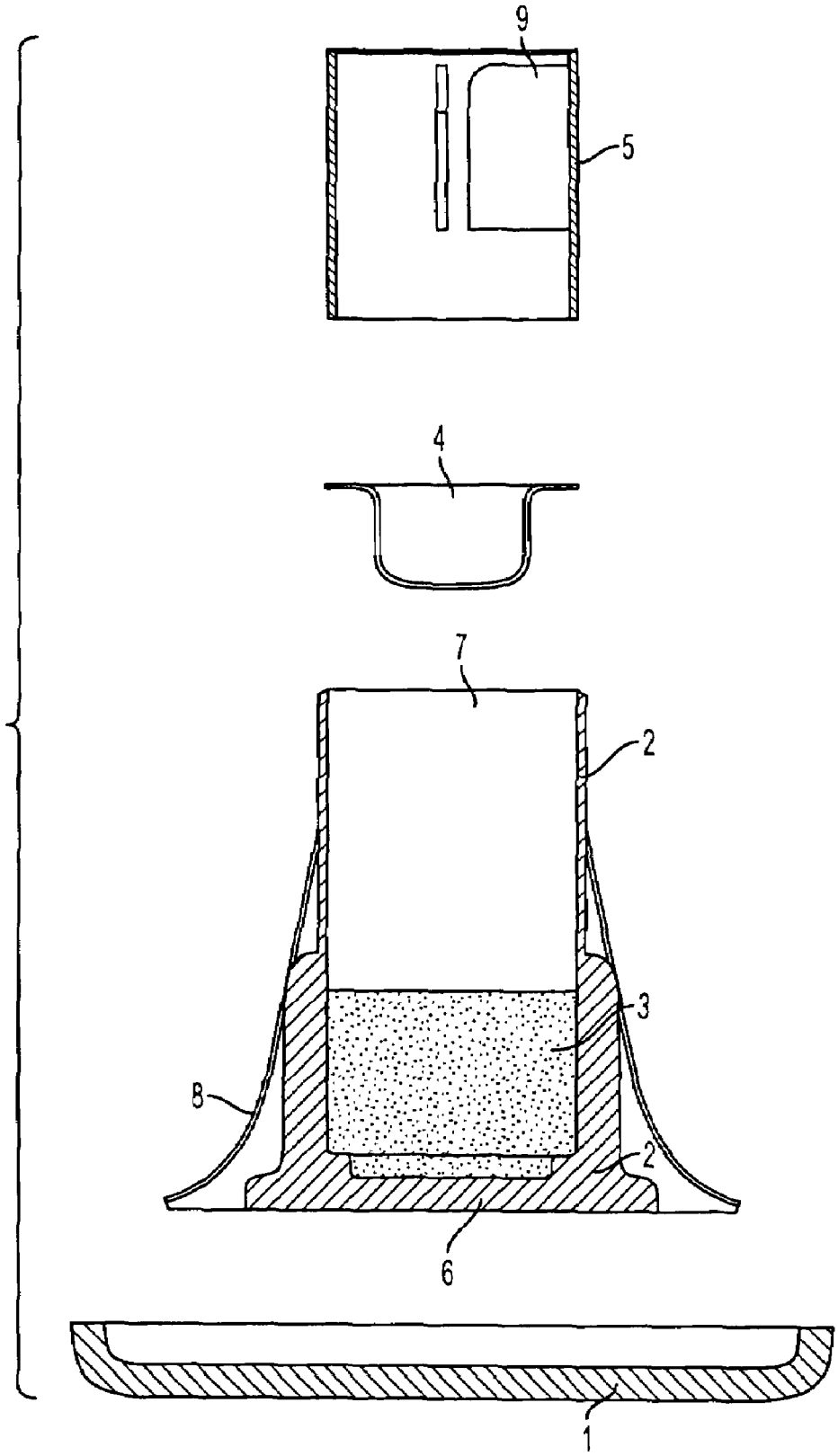
FIG. 3 is a sectional, exploded view taken vertically through the parts shown in FIG. 2, but taken prior to assembly with the cement still in the unhardened state.
Figure 4:
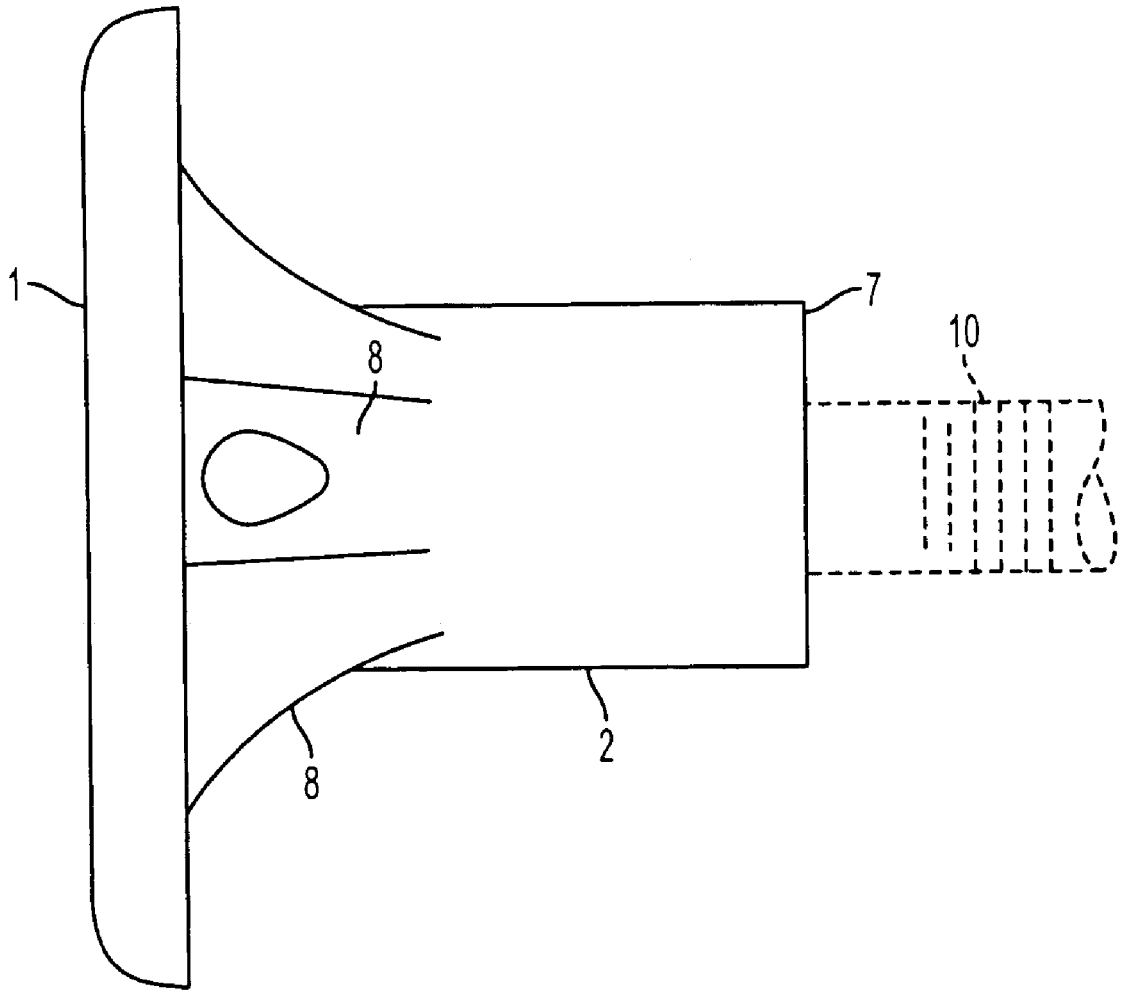
FIG. 4 is a side view of the assembled protective cover of this invention when in place over a rebar.
Figure 5:
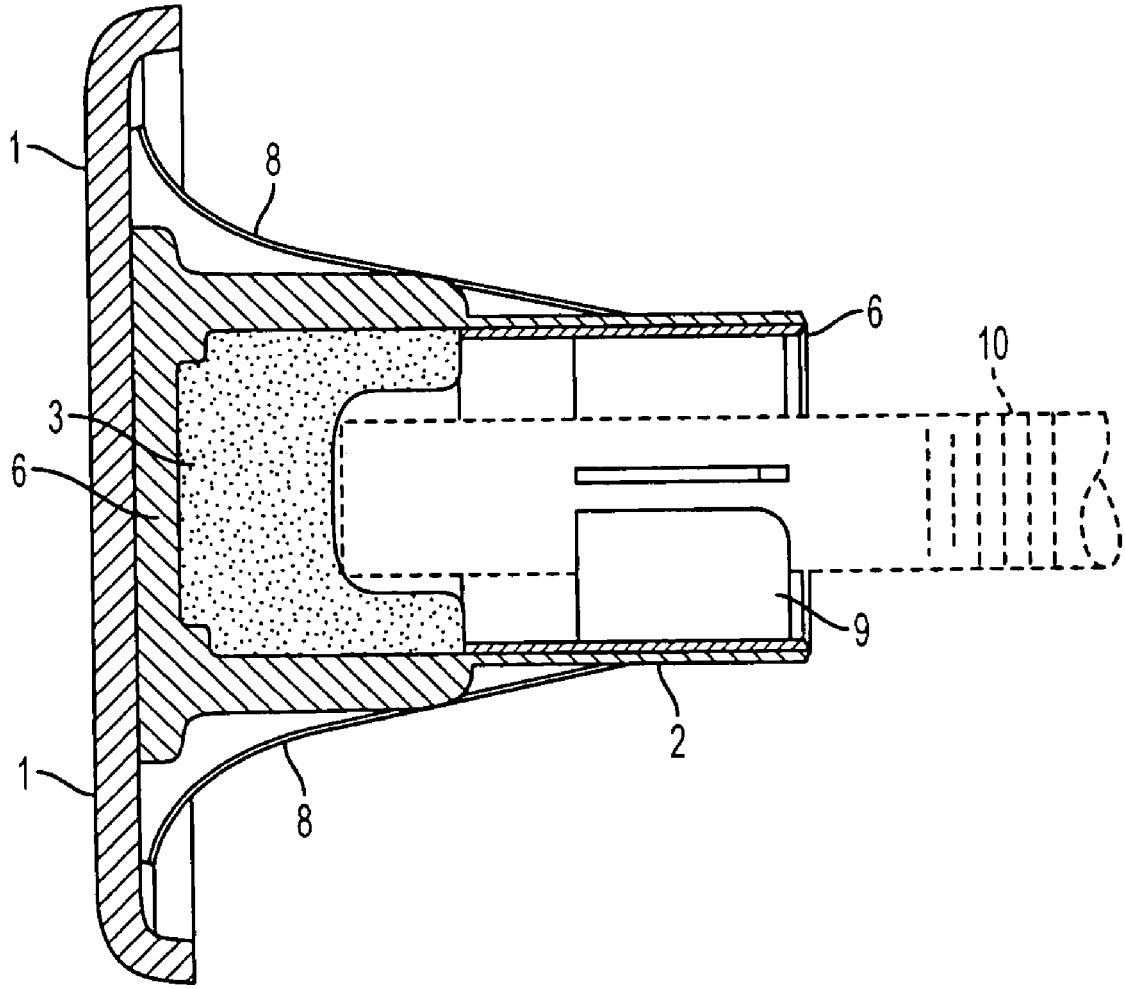
FIG. 5 is a side view in partial breakaway of the assembled protective cover of FIG. 2 positioned over rebar.

Then the putty-like cement is poured into the collar 2 in an amount sufficient so that when the shaping member 4 is inserted, the cement rises to about mid-level inside the collar 2 as shown in FIG. 2. The collar walls 11 are preferably thickened in this area. The shaping member 4 itself is not capable of absorbing high impact and serves to shape the surface of the cementitious material 3 to a bowl shape as the concrete hardens. This concrete bowl shaped surface abutting the underside of shaping member 4 acts as the high impact absorbing seat.

The fin holder 5 is then placed in the collar 2 and the impact head 1 positioned against the closed end 6 of the collar 2. The assembly is heated to cause the fin holder 5 to adhere to the inside of the collar 2 and the impact head 1 to adhere to the closed end 6 of the collar 2. This assembly can be performed before or after the cement 3 has hardened. Complete hardening of the cementitious material 3 takes about 24 hours. The shaping member 4 becomes adhered to the surface of the hardened cement 3.

Figure 7:
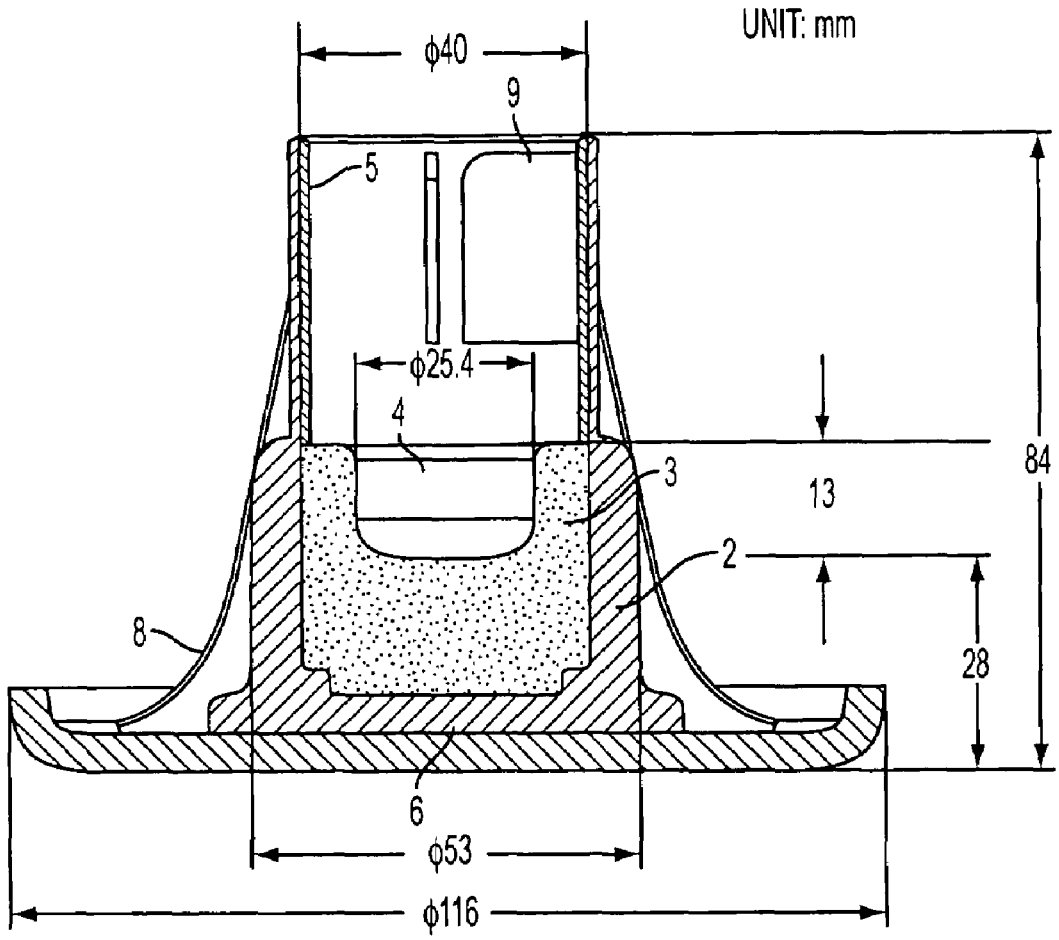
FIG. 7 is similar to FIG. 2 with the addition of the dimensions in one preferred embodiment.
Figure 8A:
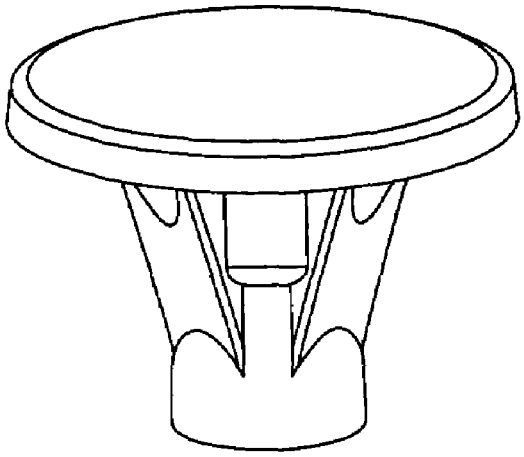
FIG. 8 shows three perspective views of the complete rebar protective cover of this invention.
Figure 8B:
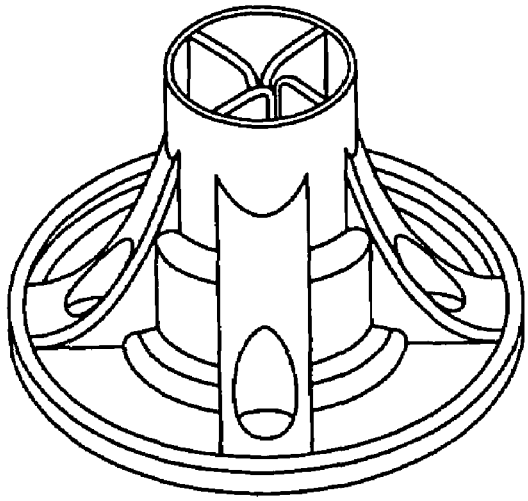
Figure 8C:
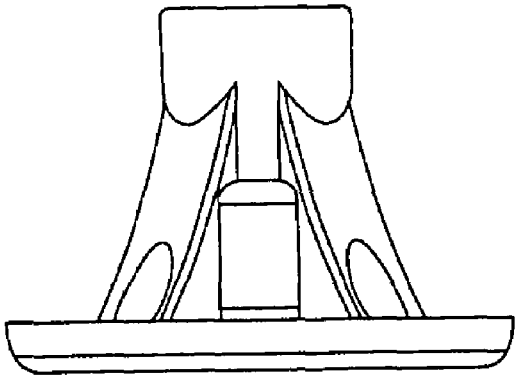

In the completed protective cover, the shaping member 4 is preferably positioned such that the top of the shaping member is about midway between the closed end 6 of the collar 2 and open end of the collar and the concave bottom surface of the shaping member 4 is about one third the distance from the closed end 6 of the collar to the open end of the collar 2. A preferred example of these dimensions is shown in FIG. 7.

The plastic parts of the protective cover of this invention are integrally molded, in standard plastic injection molding equipment, using a high molecular weight polyolefin polymers. The plastic can contain a small amount (about 0.04%) of an orange colorant such as anti-UV red, a small amount of orange pigment (about 0.032%) and a small amount of filler such as calcium chloride (about 1% to 3%), all based on the total weight of polymers. These additives are desirable, but not essential.

In my preferred embodiment, the plastic parts of the protective cover are injection molded of a homogenous mixture of two very high molecular weight polyethylene polymers as follows:

| Polymer | Molecular Weight Distribution | Density $gTcm^3$ | Percentage By Weight |
|---|---|---|---|
| Extra High Molecular Weight High Density Polyethylene | about $2.5 \times 10^5$ to about $15 \times 10^5$ | about 0.945 | about 95% |
| Ultra High Molecular Weight High Density Polyethylene | essentially all over about $15 \times 10^5$ | about 0.97 | about 5% |

The upper limit of the molecular weight of the ultra high molecular weight high density polyethylene is not critical. Such polymers currently available are believed to be only slightly above $15\times10^5$ but could be higher such as 20 or $25\times10^5$.

The two polymers are premixed and colorant, pigment and filler are added. A homogenous blend forms in the molten state which is then injected into the cavity of the mold. Injection molding equipment is used to form the protective cover to the desired shape.

The cementitious portion of the protective cover is a high strength concrete mixed with carborundum/ceramic grain.

The cementitious portion 3 of the protective cover is prepared by mixing:

| | |
|---|---|
| Carborundum: | 70%-80% |
| Cement: | 29%-19% and |
| Ceramic powder or quartzite: | 1% |

These ingredients are mixed with water. Various well known cement additives can also be added in minor amounts. Those skilled in the art can modify the ingredients and proportions.

The following are preferred ingredients:

1. The carborundum particles size: about 8-20 mesh
2. The quartzite particles size: about 40-50 mesh
3. Ceramic powder: composition is $Al_2O_3$, $SIO_2$ and MgO
4. Ceramic powder particle size: 40-50 mesh.

The upper surface of the impact head 1 of the protective cover is preferably flat as shown in the Figures. However, a domed or mushroom shaped upper surface is also acceptable.

The original Cal OSHA drop test required the protective cover be capable of withstanding at least the impact of a 250 pound weight dropped from a height of 10 feet without penetration failure of the cover. This drop test was based on the rebar being aligned with the longitudinal dimension of the cylindrical body portion.

The problem is that many prior protective covers in actual use, upon impact, allowed the rebar to penetrate and pierce the side of the cylindrical body at or around its junction with the impact head. Failures of this kind have resulted in serious industrial accidents.

Figure 6:
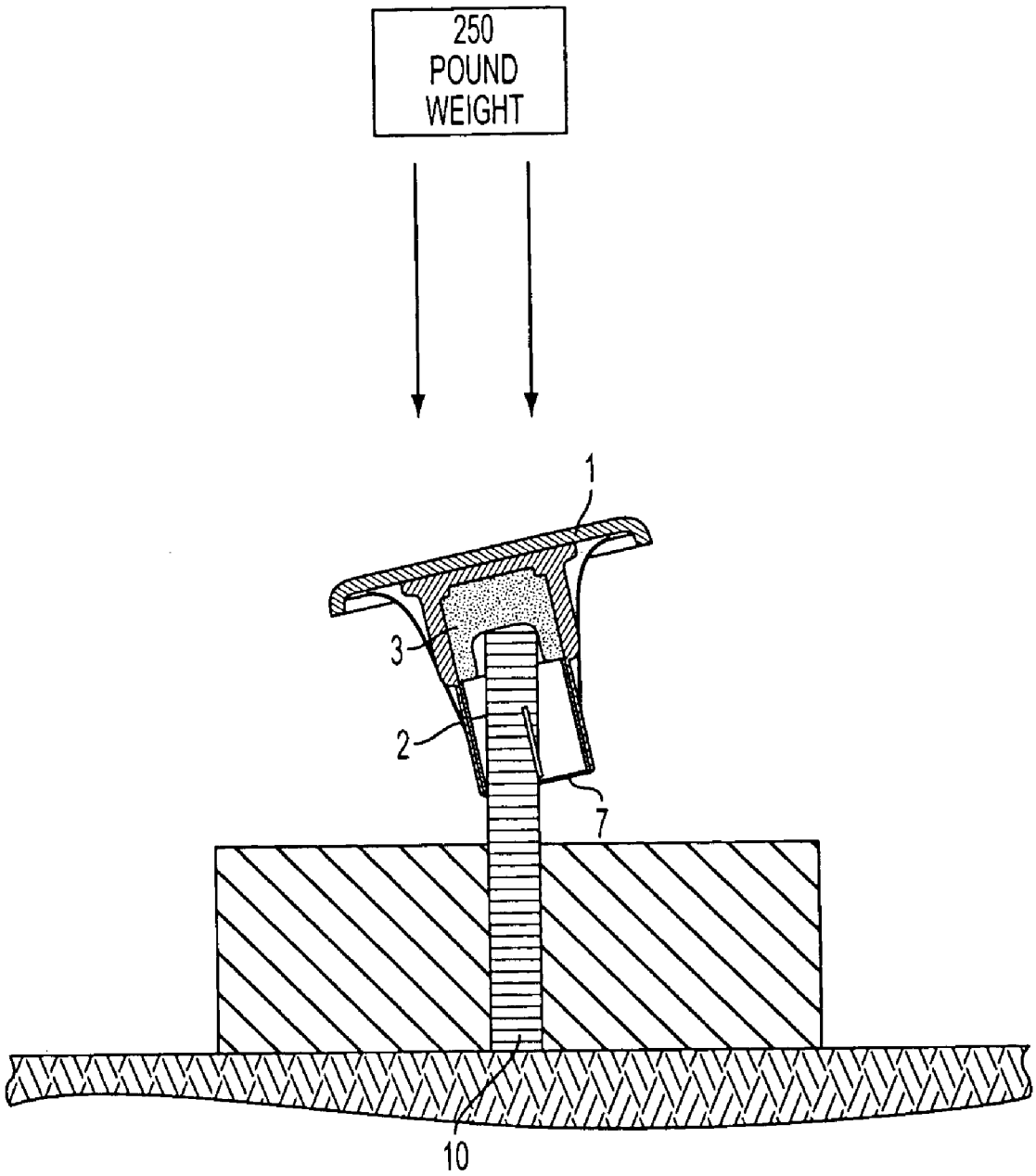
FIG. 6 shows the positioning of the assembled protective cover on the rebar at the maximum possible angle, as required by the current Cal OSHA drop test. The free end of the rebar abuts the inside of the shaping member which is separated from the closed end of the cylindrical body portion by cementitious member.

Since it was found upon severe impact that the interior flanges 9 would break or give way, allowing the protective cover to become cocked at an angle to the rebar, the latest Cal OSHA drop test requires that it be conducted with the protective cover positioned over the rebar as shown in FIG. 6.

The following test results demonstrated the efficacy of the rebar safety protective cover of this invention.

A rebar protective cover was assembled using as the cementitious material a mixture of carborundum about 75%, cement about 24% and quartzite about 1%, all of weight.

Cal OSHA DROP TEST

Test Procedure:

The drop test was conducted in accordance with the latest Cal OSHA procedure. The rebar protective cover of FIG. 7 was attached to the sheared end of a 6 inch long #4 rebar mounted on a support. The rebar was rigidly held in a vertical position during impact. A test weight was suspended above the test item at the specified drop height of 10 feet, as measured from the bottom of the test weight to the top of the test item. The test weight consisted of 250 pounds of dry sand in a Kevlar bag having a circumference of 41 inches. The test weight was slowly raised to the specified drop height. When the test weight reached the specified drop height, the test weight was quickly released by cutting the support wire cable. The test weight then impacted the test item. The test rebar protective cover was then visually inspected for evidence of physical damage. Three (3) drops were conducted: The first drop was conducted with the plastic rebar protective cover of this invention installed squarely on the rebar so that the impact head 1 is at a right angle to the lengthwise dimension of the exposed rebar. The second and third drops were performed with the plastic stabilizer flanges 9 removed from the rebar protective cover of this invention prior to the test. This allowed the rebar protective cover to sit on the rebar with the impact head, at maximum angle out of level (out of square). A drawing of this set-up may be seen in FIG. 6. The free end of the rebar abutted the inside of the shaping member 4 at its lateral extremity, as shown.

Test Data:

| | |
|---|---|
| Test Weight: | 250 pounds |
| Drop Height: | 10 feet |

Test Results:

The rebar caps completed the drop tests with no evidence of cracking and/or splitting of the cementitious material.

As used herein, the term "Cal OSHA drop test" refers to the above described test.

These results indicate that the rebar protective cover of this invention is likely to be more effective in preventing serious puncture injuries to workmen accidentally falling on the end of exposed rebar.

What is claimed is:

1. A rebar safety protective cover for use on the projecting free end of a concrete reinforcing bar to prevent impact injuries comprising:

(a) a hollow cylindrical collar, having an open end and a closed end, (b) an overhanging impact head of substantial extent projecting laterally outwardly beyond the closed end of said collar, (c) a bowl-shaped shaping member having the concave surface facing the open end of the collar, said shaping member comprising a plastic material, (d) a solid cementitious member occupying the space between said closed end of the collar and the underside of said shaping member, said cementitious member having a surface abutting the underside of said shaping member complementary to said shaping member and adapted to resist impact penetration, said cementitious member preventing penetration of the cover by rebar.

2. The rebar safety protective cover of claim 1 wherein the cementitious member comprises cement, carborundum and ceramic particles.

3. The rebar safety protective cover of claim 1 wherein said plastic material includes a mixture of polyethlenes, one having a density of about 0.945 and another of about 0.97.

4. The rebar safety protective cover of claim 3 wherein the first mentioned polyethylene is present at about 95 weight percentage and the another at about 5 weight percent.

5. The rebar safety protective cover of claim 1 wherein the plastic material includes a mixture of polyethylenes, one having a molecular weight in the range from about $2.5\times10^5$ to about $15\times10^5$ and another a molecular weight in the range above about $15\times10^5$.

6. The rebar safety protective cover of claim 5 wherein said first mentioned polyethylene has a density of about 0.945 and the another polyethylene a density of about 0.97.

7. The rebar safety protective cover of claim 6 wherein the first mentioned polyethylene is present in a weight amount of about 95% and the another polyethylene in a weight about of about 5%.

8. The rebar safety protective cover of claim 1 wherein said impact head has a flat outer surface for receiving impact.

9. The rebar safety protective cover of claim 1 wherein said plastic material comprises a polyefin.

10. In combination, a rebar used to reinforce concrete wherein the rebar has an exposed free end, and a safety protective cover disposed on said exposed free end, said protective cover comprising:

(a) a hollow cylindrical collar, having an open end and a closed end, (b) a flat overhanging impact head of substantial extent projecting laterally outwardly beyond the closed end of the collar, (c) a bowl-shaped shaping member having the concave surface facing the open end of the collar, said shaping member comprising a plastic material, (d) a solid cementitious member occupying the space between said closed end of the collar and the underside of said shaping member, said cementitious member having a surface abutting the underside of said shaping member complementary to said shaping member and adapted to resist impact penetration, said cementitious member preventing penetration of the cover by rebar.

11. The combination of claim 10 wherein the cementitious member comprises cement, carborundum and ceramic particles.

12. The combination of claim 10 wherein said plastic material includes a mixture of polyethylenes, one having a density of about 0.945 and another of about 0.97.

13. The combination of claim 12 wherein the first mentioned polyethylene is present at about 95 weight percentage and the another at about 5 weight percent.

14. The combination of claim 10 wherein the plastic material includes a mixture of polyethylene, one having a molecular weight in the range from about $2.5\times10^5$ to about $15\times10^5$ and another a molecular weight in the range above about $15\times10^5$.

15. The combination of claim 14 wherein said first mentioned polyethylene is present in a weight amount of about 95% and the another polyethylene in a weight about of about 5%.

16. The combination of claim 13 wherein the first mentioned polyethylene has a density of about 0.945 and the another polyethylene a density of about 0.97.

17. The combination of claim 10 wherein said impact head has a flat outer surface for receiving impact.

18. The combination of claim 10 wherein said plastic material comprises a polyefin.

* * * * *